US005331680A

United States Patent [19]

Ueno

[11] Patent Number: 5,331,680

[45] Date of Patent: Jul. 19, 1994

[54] POSITION DETECTING APPARATUS

[75] Inventor: Shigenori Ueno, Numazu, Japan

[73] Assignee: Tokyo Electric Co., Ltd., Tokyo, Japan

[21] Appl. No.: 838,153

[22] Filed: Feb. 18, 1992

[30] Foreign Application Priority Data

Feb. 22, 1991 [JP] Japan ..... 3-028214

[51] Int. Cl.[5] ..... G06M 3/02

[52] U.S. Cl. ..... 377/17; 346/140.1; 400/320

[58] Field of Search ..... 377/17, 18; 400/320; 346/140 R

[56] References Cited

U.S. PATENT DOCUMENTS

| | | | |
|---|---|---|---|
| 3,843,873 | 10/1974 | Beville et al. | 377/17 |
| 4,112,291 | 9/1978 | Fukuyama et al. | 377/17 |
| 4,171,522 | 10/1979 | Powell | 377/17 |
| 4,234,787 | 11/1980 | Hutter et al. | 377/17 |
| 4,244,514 | 1/1981 | Nomura et al. | 377/17 |
| 4,338,035 | 7/1982 | Kondo et al. | 400/144.2 |
| 4,427,970 | 1/1984 | Devol | 377/17 |
| 4,511,797 | 4/1985 | Pohlig et al. | 377/17 |
| 4,897,647 | 1/1990 | Sakamoto et al. | 377/17 |
| 5,138,639 | 8/1992 | Nakamura | 377/17 |

FOREIGN PATENT DOCUMENTS

| | | |
|---|---|---|
| 0372844 | 6/1990 | European Pat. Off. . |
| 60-129803 | 7/1985 | Japan . |
| 63-145913 | 6/1988 | Japan . |
| WO90/08039 | 7/1990 | World Int. Prop. O. . |

OTHER PUBLICATIONS

Patent Abstracts of Japan, vol. 12, No. 142 (M-692) (2989) Apr. 30, 1988 & JP-A-62 264 981 (Konishiroku) Nov. 17, 1987.

Patent Abstracts of Japan, vol. 9, No. 94 (M-374) (1817) Apr. 24, 1985 & JP-A-59 220 391 (Fujitsu KK) Dec. 11, 1984.

*Primary Examiner*—John S. Heyman

*Attorney, Agent, or Firm*—Frishauf, Holtz, Goodman & Woodward

[57] ABSTRACT

A position detecting apparatus comprises a motion detecting section for generating a pulse when a carriage passes each of coordinate points set in a reciprocal movement span thereof at a predetermined pitch, and a counting section for storing position data representing an initial position of the carriage in advance, incrementing the position data in response to a pulse which is generated by the motion detecting section when the carriage is moved in the forward direction, and decrementing the position data in response to a pulse which is generated by the motion detecting section when the carriage is moved in the backward direction. Particularly, the position detecting apparatus further comprises a position data correcting section for controlling the counting section to correct the position data when the carriage is moved in the backward direction so that the position data represents a position shifted in the forward direction by a predetermined amount and to cancel the correction when the carriage is moved in the forward direction.

7 Claims, 4 Drawing Sheets

POSITION DETECTING APPARATUS

BACKGROUND OF THE INVENTION

1. Field of the Invention

The present invention relates to a serial printer having a carriage for conveying a print head and, more particularly, to a position detecting apparatus for detecting a current position of the carriage to control the drive timing of the print head.

2. Description of the Related Art

A typical serial printer is arranged as follows. A carriage having a print head thereon is moved parallel to a platen, and the print head is driven according to print data while a paper sheet on the platen is scanned by the print head which moves together with the carriage. Such a printer comprises a position detecting apparatus to control the drive timing of the print head. This position detecting apparatus detects a current position of the carriage while the carriage is moved back and forth according to the rotation of a carriage motor, and generates position data representing the current position of the carriage. The print head is driven upon update of the position data obtained from the position detecting apparatus.

The position detecting apparatus has a linear encoder for generating an output signal which changes in level when a portion of the carriage passes each of coordinate points set in the platen span at a predetermined pitch, a pulse generator for generating a pulse in response to a level change in the output signal from the linear encoder, and a counter for counting the number of pulses generated by the pulse generator. In the initial state, the counter retains, e.g., "1" as position data representing the home position of the carriage. The position data is incremented by "1" in response to a pulse which is generated by the pulse generator when the carriage is moved forward, and is decremented by "1" in response to a pulse which is generated by the pulse generator when the carriage is moved backward.

The position detecting apparatus has the following drawback in a case where the serial printer is of an ink-jet type and performs a bi-directional printing. Generally, a serial printer of this type prints dots by injecting ink from the print head toward a paper sheet. Since the print head cannot immediately inject ink after it is driven, the printing position is deviated due to the movement of the carriage during the time lag.

FIG. 1(*a*) shows the position of the carriage at which the output signal of the linear encoder changes in level, FIG. 1(*b*) shows position data output from the position detecting apparatus when the carriage is moved forward, and FIG. 1(*c*) shows position data output from the position detecting apparatus when the carriage is moved backward. The position detecting apparatus outputs common position data n when the carriage passes a position P1 in its forward movement and when the carriage passes a position P2 in its backward movement. When the printer drives the print head at the timing the position data n is obtained, the print head prints dots at a position R1 or R2. (R1 denotes the position of dots printed in the forward movement of the carriage, and R2 denotes the position of dots printed in the backward movement of the carriage.) Since the printing position of dots changes depending on the moving direction of the carriage, it is difficult to align characters or symbols formed of the printed dots in the paper feed direction.

SUMMARY OF THE INVENTION

It is an object of the present invention to provide a position detecting apparatus which can decrease an alignment error in dots printed by hi-directional printing.

This object is achieved by a position detecting apparatus comprising a motion detecting section for generating a pulse when a carriage passes each of coordinate points set in a reciprocal movement span thereof at a predetermined pitch, a counting section for storing position data representing an initial position of the carriage in advance, incrementing the position data in response to a pulse which is generated by the motion detecting section when the carriage is moved in a first direction, and decrementing the position data in response to a pulse which is generated by the motion detecting section when the carriage is moved in a second direction, and a position data correcting section for controlling the counting section to correct the position data when the carriage is moved in the second direction so that the position data represents a position shifted in the first direction by a predetermined amount and to cancel the correction when the carriage is moved in the first direction.

According to this position detecting apparatus, when the moving direction of the carriage is changed from the first direction to the second direction, the printing timing is advanced by the correction of the position data. As a result, if there is relatively large displacement between the printing position when the carriage is moved in the first direction and the printing position when the carriage is moved in the second direction, it can be reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

A position detecting apparatus according to an embodiment of the present invention will be described with reference to the accompanying drawings.

The position detecting apparatus is incorporated in an ink-jet type serial printer which moves a carriage having a print head thereon in parallel with a platen, and drives the print head according to print data while a paper sheet on the platen is scanned by the print head which moves together with the carriage. The drive timing of the print head is controlled by using the position detecting apparatus.

Figure 2:
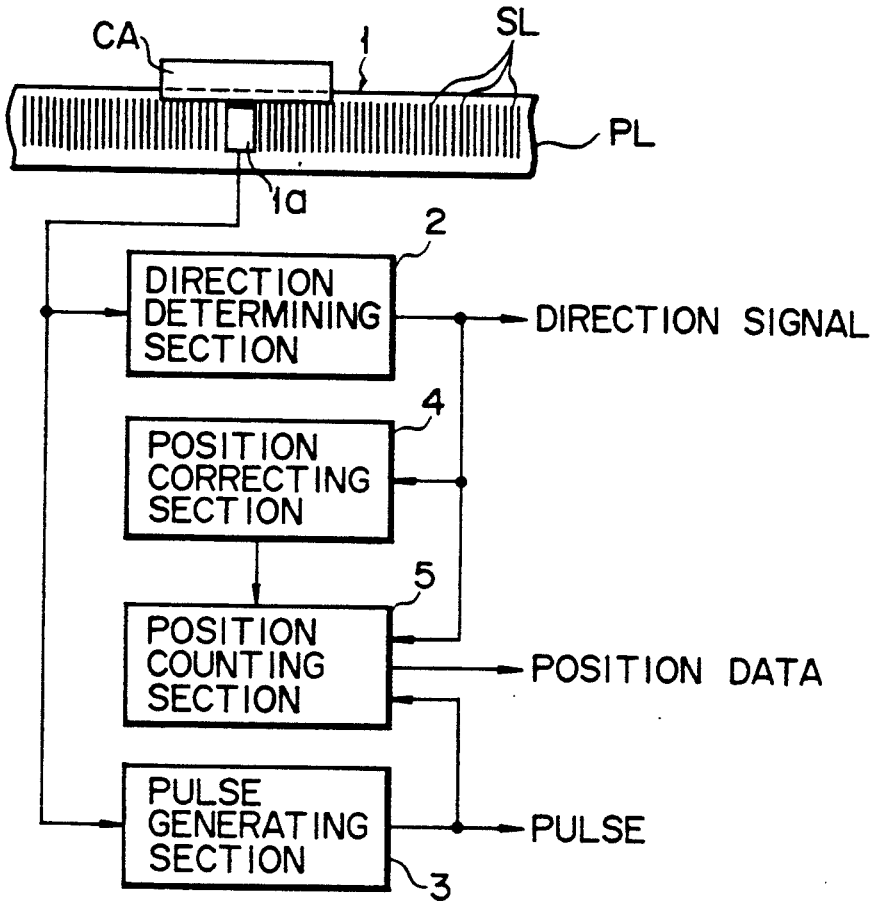
FIG. 2 is a block diagram showing an arrangement of a position detecting apparatus according to an embodiment of the present invention.
Figure 3:
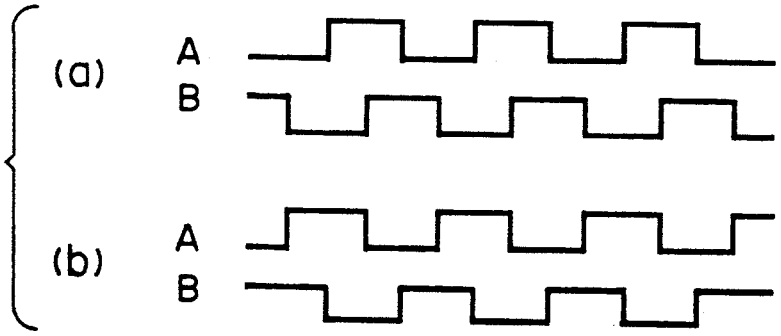
FIGS. 3(*a*) and 3(*b*) are waveform charts showing output signals from an encoder sensor shown in FIG. 2.

FIG. 2 shows an arrangement of the position detecting apparatus. This apparatus comprises a linear encoder 1, a direction determining section 2, a pulse generating section 3, a position correcting section 4, and a position counting section 5. The linear encoder 1 is composed of a belt-shaped plate PL provided corresponding to a platen span, and an encoder sensor 1*a* mounted on a carriage CA. The plate PL has a plurality of slits arranged at a predetermined interval in the reciprocal movement range of the carriage CA and representing coordinate points set in the range. The encoder sensor 1*a* detects the slits SL during the movement of the carriage CA to generate a 2-phase signal having waves A and B whose levels are alternately inverted in synchronism with detection of a slit SL. As shown in FIG. 3(*a*), the phase of the wave A is advanced than that of the wave B when the carriage CA is moved in the forward direction. As shown in FIG. 3(*b*), The phase of the wave B is advanced than that of the wave A when the carriage CA is moved in the backward direction. The 2-phase signal is supplied from the encoder sensor 1*a* to the direction determining section 2 and the pulse generating section 3. The direction determining section 2 detects the moving direction of the carriage CA from the 2-phase signal, and generates a direction signal which indicates the detected direction. The direction signal is set to "H" level when the carriage CA is moved in the forward direction, and to "L" level when the carriage CA is moved in the backward direction. The pulse generating section 3 generates a pulse in response to a level change in each of waves A and B of the 2-phase signal supplied from the encoder sensor 1*a*, and supplies the pulse to the position counting section 5. The position correcting section 4 generates a pulse in response to a level change in the direction signal supplied from the direction determining section 2. The position counting section 5 stores position data indicating an initial position of the carriage CA, increments the position data by "1" in response to a pulse from the pulse generating section 3 when the direction signal from the direction determining section 2 is at "H" level, and decrements the position data by "1" in response to a pulse from the pulse generating section 3 when the direction signal from the direction determining section 2 is at "L" level.

Further, the position counting section 4 decrements the position data by "1" in response to a pulse supplied from the position correcting section 4 immediately after the direction signal from the position determining section 2 is changed from "H" level to "L" level, and increments the position data by "1" in response to a pulse supplied from the position correcting section 2 immediately after the direction signal from the position determining section is changed from "L" level to "H" level. This position data is output from the position counting section 5 to control the drive timing of the carriage CA.

Next, an operation of the position detecting apparatus will be described.

Figure 4:
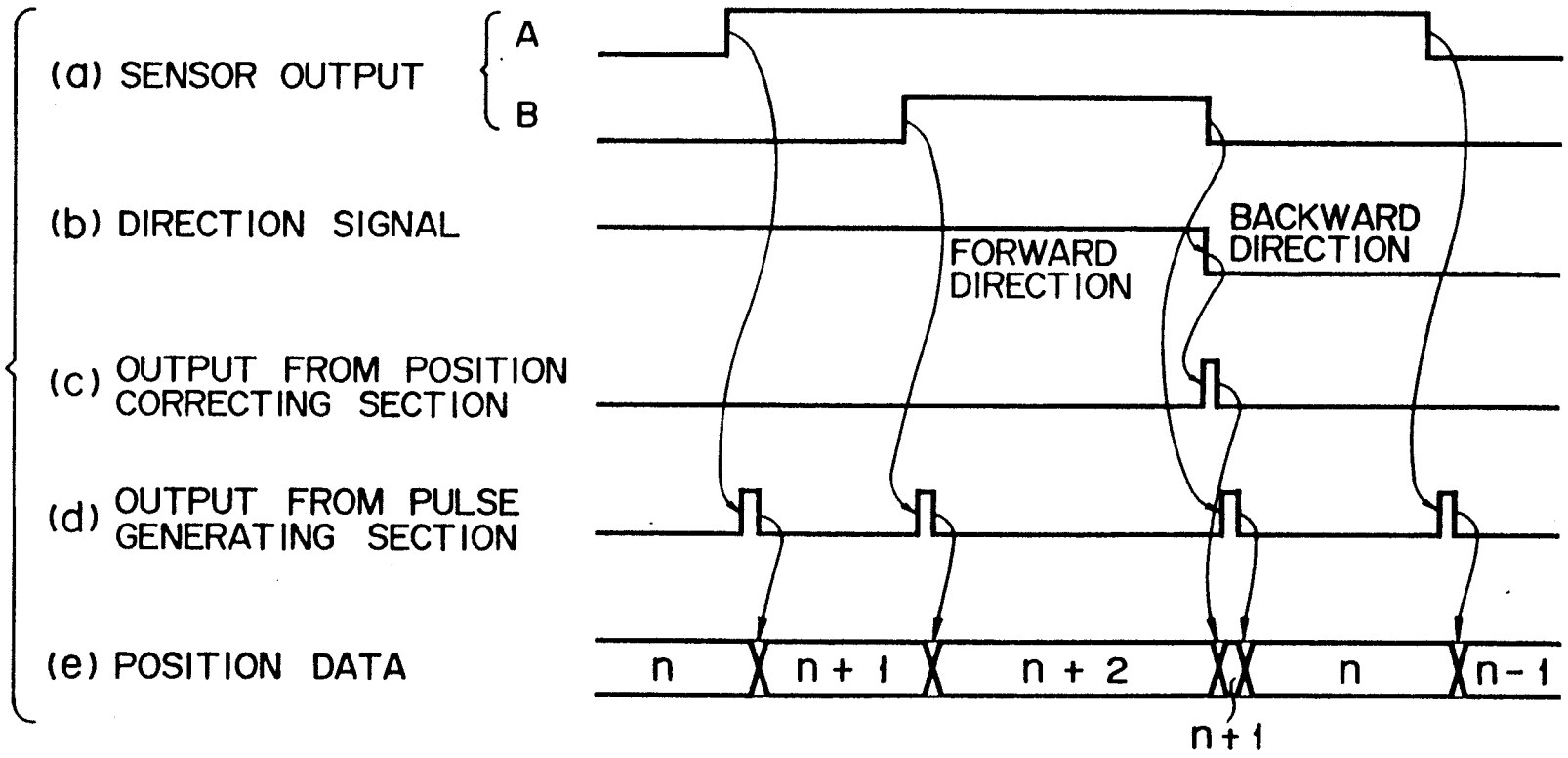
FIGS. 4(*a*) to 4(*e*) are timing charts for explaining an operation of the position detecting apparatus shown in FIG. 2.

FIG. 4(*a*) shows a 2-phase signal generated from the encoder sensor la when the moving direction of the carriage CA is reversed. When the wave A of the 2-phase signal rises in the forward movement of the carriage CA, the pulse generating section 3 generates a pulse in response to the rise of the wave A as shown in FIG. 4(*d*). The counting section 5 counts up the pulse and updating its position data "n" to "n+1" as shown in FIG. 4(*e*). Then, the wave B of the 2-phase signal rises as shown in FIG. 4(*a*). The pulse generating section generates a pulse in response to the rise of the wave B as shown in FIG. 4 (*a*). The pulse counting section counts up the pulse and updates its position data "n+1" to "n+2" as shown in FIG. 4 (*e*).

Thereafter, the moving direction of the carriage CA is changed. At this time, the wave B of the 2-phase signal falls prior to the wave A as shown in FIG. 4(*a*), and the direction signal from the direction determining section 2 falls as shown in FIG. 4(*b*). The position correcting section 4 detects this level change of the direction signal, and supplies a pulse to the position counting section 5. Since the direction signal is set at "L" level, the position counting section 5 counts down the pulse and updates its position data "n+2" to "n+1". The position counting section 5 further counts down the pulse generated when the wave B falls as described above, and updates its position data "n+1" to "n". Then, the wave A falls as shown in FIG. 4 (*a*). The pulse generating section 3 generates a pulse in response to the fall of the wave A, and supplies the pulse to the position counting section 5. The position counting section 5 counts down the pulse and updates its position data "n" to "n−1".

In a case where the moving direction of the carriage CA is changed from backward direction to the forward direction, the position detecting apparatus operates in the same manner as described above, except that the position counting section 5 counts up a pulse from the position correcting section 4.

Figure 1:
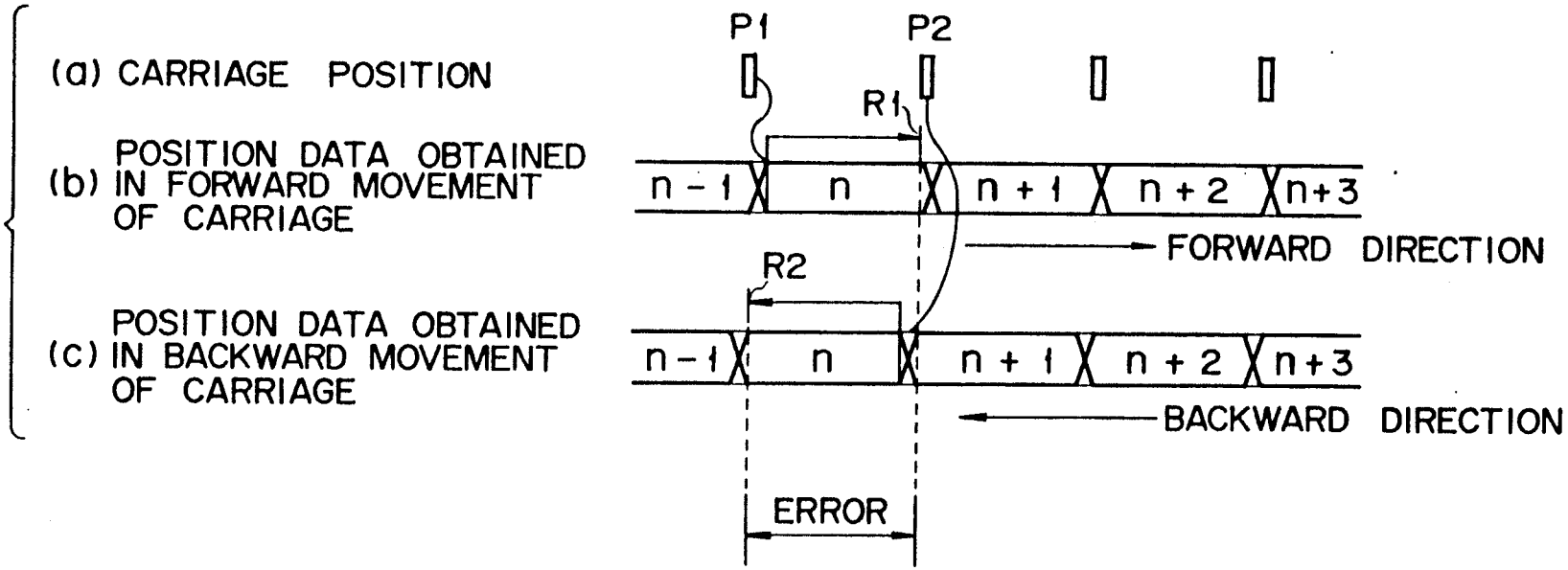
FIG. 1 (PRIOR ART)
FIGS. 1(*a*) to (*c*) show a relationship between the position data output from a conventional position detecting apparatus and a carriage position.
Figure 5:
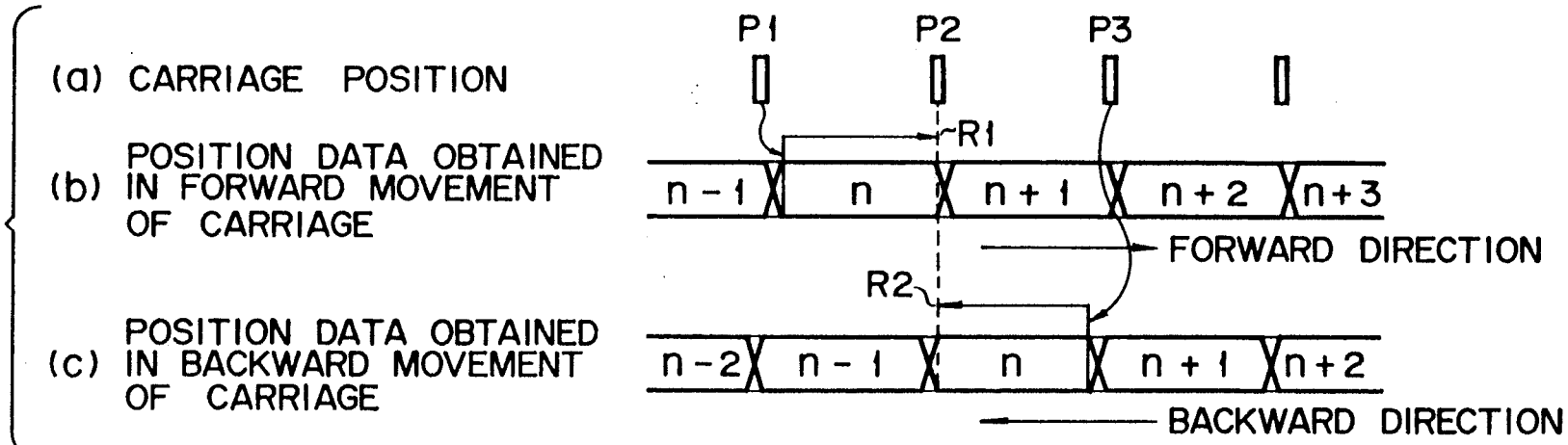
FIGS. 5(*a*) to 5(*c*) are views showing a relationship between the position data output by the position detecting apparatus shown in FIG. 2 and a carriage position.

FIG. 5(*a*) shows the position of the carriage CA at which the 2-phase signal of the linear encoder 1 changes in level, FIG. 5(*b*) shows position data output from the position counting section 5 when the carriage CA is moved forward, and FIG. 1(*c*) shows position data output from the position detecting apparatus when the carriage CA is moved backward. The position detecting apparatus outputs common position data "n" when the carriage CA passes the position P1 in the forward movement and when the carriage CA passes the position P3 in the backward movement. When the printer drives the print head upon receipt of the position data "n" output from the position counting section 5, the print head prints dots at the position R1 in the forward movement and at the position R2 in the backward movement. The positions R1 and R2 are almost identical to the position P2 of the carriage CA. (The amount of correction in the position data must be appropriately changed in accordance with the time for the print head to inject ink after it is driven.)

According to the above-described embodiment, the position detecting apparatus corrects the position data by decrementing the position data when the moving direction of the carriage CA is changed from the forward direction to the backward direction, and cancel the correction when the moving direction of the carriage CA is changed from the backward direction to the forward direction. Therefore, the drive timing of the print head is advanced in the backward movement of the carriage CA, reducing the distance between the position R1 of dots printed in the forward movement of the carriage CA and the position R2 of dots printed in the backward movement of the carriage CA. Accordingly, it is possible to align characters or symbols formed of the printed dots in the paper feed direction.

Although the preferred embodiment of the present invention have been disclosed and described, it is apparent that other embodiments and modifications are possible.

For example, the position correcting section 4 controls the position counting section 5 to correct the position data stored therein when the moving direction of the carriage is changed. However, the position correcting section 4 may control the position counting section 5 to retrieve the position data stored therein and correct it in the forward movement of the carriage CA (or in the backward movement of the carriage CA).

Further, in a case where the direction signal indicating the moving direction of the carriage CA is obtained from a control circuit of the printer, it is not necessary to provide the direction determining section 2.

In this embodiment, the position detecting apparatus is used in the serial printer of a ink-jet type. However, the position detecting apparatus can be used in the serial printer of another type which performs bidirectional printing with a print head whose response time is relatively long.

What is claimed is:

1. A position detecting apparatus for use in a bidirectional printer having a carriage and a print head mounted on the carriage, the print head driven to produce printing while the carriage is moving in forward and backward directions along an axis on which coordinate points are set at a predetermined pitch, comprising:

motion detecting means for detecting a first motion of said carriage passing one of the coordinate points during one of forward and backward movements thereof, and for detecting a second motion of said carriage passing one of the coordinate points during the other one of the forward and backward movements thereof;

counting means for storing position data representing a current position of said carriage, for updating the position data by incrementing the position data upon detection of the first motion and by decrementing the position data upon detection of the second motion, thereby causing the print head to be driven each time the position data is updated; and correcting means for correcting the position data in said counting means when the moving direction of said carriage is reversed from one of the forward and backward directions to the other of the forward and backward directions, the amount of correction being determined to reduce a difference between printing positions set during said forward and backward movements for the same position data.

2. The position detecting apparatus of claim 1, wherein said motion detecting means comprises:

a linear encoder for generating a 2-phase signal of first and second waveforms which alternately change in level when said carriage passes each of the coordinate points, and wherein one of said waveforms is advanced in phase relative to the other according to the moving direction of said carriage; and pulse generating means for generating a pulse in response to a level change in each of said first and second waveforms of said 2-phase signal.

3. The position detecting apparatus of claim 2, wherein said motion detecting means further comprises direction detecting means for detecting the moving direction of said carriage on the basis of the relation in phase between the first and second waveforms of the 2-phase signal to produce a direction signal representing the moving direction of said carriage.

4. The position detecting apparatus of claim 3, wherein said counting means comprises means for incrementing the position data in response to a pulse from said pulse generating means when said one direction is detected by said direction means, and for decrementing the position data in response to a pulse from said pulse generating means when said other direction is detected by said direction detecting means.

5. The position detecting apparatus of claim 3, wherein said linear encoder comprises:

a plate having a plurality of slits representing said coordinate points; and an encoder sensor mounted on said carriage for detecting said slits as said carriage moves.

6. The position detecting apparatus of claim 3, wherein said correcting means comprises monitor means for monitoring the direction signal from said direction detecting means to detect that the moving direction of said carriage has been reversed from said one direction to said other direction.

7. The position detecting apparatus of claim 1, wherein said print head is an ink-jet print head which is driven to eject ink to print on a sheet while the print head is moving relative to the sheet.

* * * * *